US006255952B1

(12) United States Patent
Jang

(10) Patent No.: US 6,255,952 B1
(45) Date of Patent: Jul. 3, 2001

(54) METHOD AND SYSTEM FOR WARNING OF ABNORMAL WATER SUPPLY IN A WASHING MACHINE

(75) Inventor: Bong-An Jang, Suwon (KR)

(73) Assignee: Samsung Electronics Co., Ltd., Kyungi-Do (KR)

( * ) Notice: Subject to any disclaimer, the term of this patent is extended or adjusted under 35 U.S.C. 154(b) by 0 days.

(21) Appl. No.: 09/497,404

(22) Filed: Feb. 3, 2000

(30) Foreign Application Priority Data

Aug. 18, 1999 (KR) ..... 99-34051

(51) Int. Cl.[7] ..... G08B 17/00

(52) U.S. Cl. ..... 340/588; 340/517; 340/589; 68/12.21; 8/159

(58) Field of Search ..... 340/517, 588, 340/589; 219/492, 494, 497, 501; 68/12.03, 12.04, 22 R, 12.21, 12.28; 8/158, 159

(56) References Cited

U.S. PATENT DOCUMENTS 4,195,500 * 4/1980 Tobita et al. ..... 340/517
4,854,498 * 8/1989 Stayton ..... 236/12.12
5,299,340 * 4/1994 Moon ..... 8/158
5,388,178 * 2/1995 Moon ..... 219/497
5,449,884 * 9/1995 Lee ..... 219/497

FOREIGN PATENT DOCUMENTS 10-71297 3/1998 (JP) .

* cited by examiner

*Primary Examiner*—Van T. Trieu
(74) *Attorney, Agent, or Firm*—Larson & Taylor PLC

(57) ABSTRACT

A method and system for warning of an abnormal water supply in a washing machine first determines whether cool and hot water supply valves are opened or closed, and then detects a temperature of water being supplied to the washing machine when one of the cool and hot water supply valves is opened. Next, a temperature type of water according to the detected temperature of the water is identified and it is determined whether the water is normally supplied or not by comparing opened/closed states of the cool and hot water supply valves with the temperature type of water identified. Finally, an alarm of an abnormal water supply is given when the water is abnormally supplied.

10 Claims, 6 Drawing Sheets

METHOD AND SYSTEM FOR WARNING OF ABNORMAL WATER SUPPLY IN A WASHING MACHINE

FIELD OF THE INVENTION

The present invention relates to a method for warning of an abnormal water supply in a washing machine which determines an abnormal water supply by using both a temperature of ambient air and a temperature of water supplied to a washing machine, and warns of the abnormal water supply to a user.

BACKGROUND OF THE INVENTION

Generally, a washing machine is designed with two water supply hoses, both of which are directed to a common water supply port through which the water is fed into a water reserving drum.

FIG. 1 shows such a conventional washing machine.

A cool water supply hose 11 and a hot water supply hose 12 are respectively connected to corresponding taps and converged into one hose through respective water supply valves 13 and 14. The converged hose extends inside a water supply tank 15. Water directed into the water supply tank 15 through one or both of the cool and hot water supply hoses 11 and 12 and then through the converged hose is supplied into a water reserving drum through a water supply port formed on the water supply tank 15.

Since the above-described conventional washing machine has only one water supply port while having two water supply hoses 11 and 12, if the cool water supply hose 11 and the hot water supply hose 12 are inadvertently connected to the wrong taps (i.e., switched), a microcomputer cannot identify such an incorrect connection and unconditionally processes the washing operation upon identifying that washing water is supplied through the water supply port. Therefore, there is the possibility that water of the wrong temperature is supplied (i.e., cool water is supplied when hot water should be supplied and vice versa).

In addition, even when the cool and hot water supply hoses 11 and 12 are correctly connected to the taps, water supply problems may occur when the taps are turned off. That is, if the water supply valves 13 and 14 are opened, the microcomputer operates a pulsator to perform a washing operation even if the taps are turned off. As a result, the washing machine is operated in a state where washing water is not supplied.

BRIEF SUMMARY OF THE INVENTION

Therefore, there is a need for a washing machine which is designed to sound an alarm to a user if operating conditions of a washing machine such as connections of water supply hoses are not satisfied.

To meet the above need, the present invention provides a method and system for warning of an abnormal water supply using both a temperature of ambient air and a temperature of water supplied to a washing machine.

According to one aspect of the present invention, a method for warning of an abnormal water supply in a washing machine comprises the steps of: determining whether each of the respective cool and hot water supply valves is opened or closed; detecting a temperature of water being supplied to the washing machine when at least one of the cool and hot water supply valves is opened; identifying a temperature type of water being supplied according to the detected temperature of the water; determining whether the water is normally or abnormally supplied by comparing the determined opened cool and/or hot water supply valves with the temperature type of water identified; and giving an alarm of an abnormal water supply when the water is abnormally supplied.

According to a first embodiment of the present invention, the step of detecting a temperature of water further comprises the steps of: counting a water supply time; determining whether the water supply time reaches a predetermined time or not; and detecting a temperature of the water when the water supply time reaches the predetermined time.

According to a second embodiment of the present invention, the step of detecting a temperature of water further comprises the steps of: detecting a temperature of water many times at a predetermined time interval; determining whether the number of temperature detecting times reaches to a predetermined number or not; and calculating a mean temperature when the number of temperature detecting times reaches to the predetermined number.

According to another aspect of the present invention, a system for giving an alarm of an abnormal water supply in a washing machine is provided. The washing machine includes a water drum, cool and hot water supply hoses for directing water into the water drum, cool and hot water supply valves mounted on the cool and hot water supply hoses, respectively, and a water supply port through which the water passing through the cool and hot water supply valves is supplied to the water drum. The system comprises: a temperature detecting sensor disposed in the vicinity of the water supply port which detects a temperature of an ambient air prior to opening of any water supply valve and of water being supplied through the water supply port after opening of any water supply valve; means for determining an abnormal water supply in accordance with the ambient air temperature and the water temperature detected by the temperature detecting sensor; and means for giving an alarm to a user when the means for determining determines the abnormal water supply.

BRIEF DESCRIPTION OF THE SEVERAL VIEWS OF THE DRAWINGS

The accompanying drawings, which are incorporated in and constitute a part of the specification, illustrate embodiments of the invention, and, together with the description, serve to explain the principles of the invention.

DETAILED DESCRIPTION OF THE INVENTION

Reference will now be made in detail to the presently preferred embodiments of the invention, examples of which are illustrated in the accompanying drawings. Wherever possible, the same reference numbers will be used throughout the drawings to refer to the same or like parts.

Figure 1:
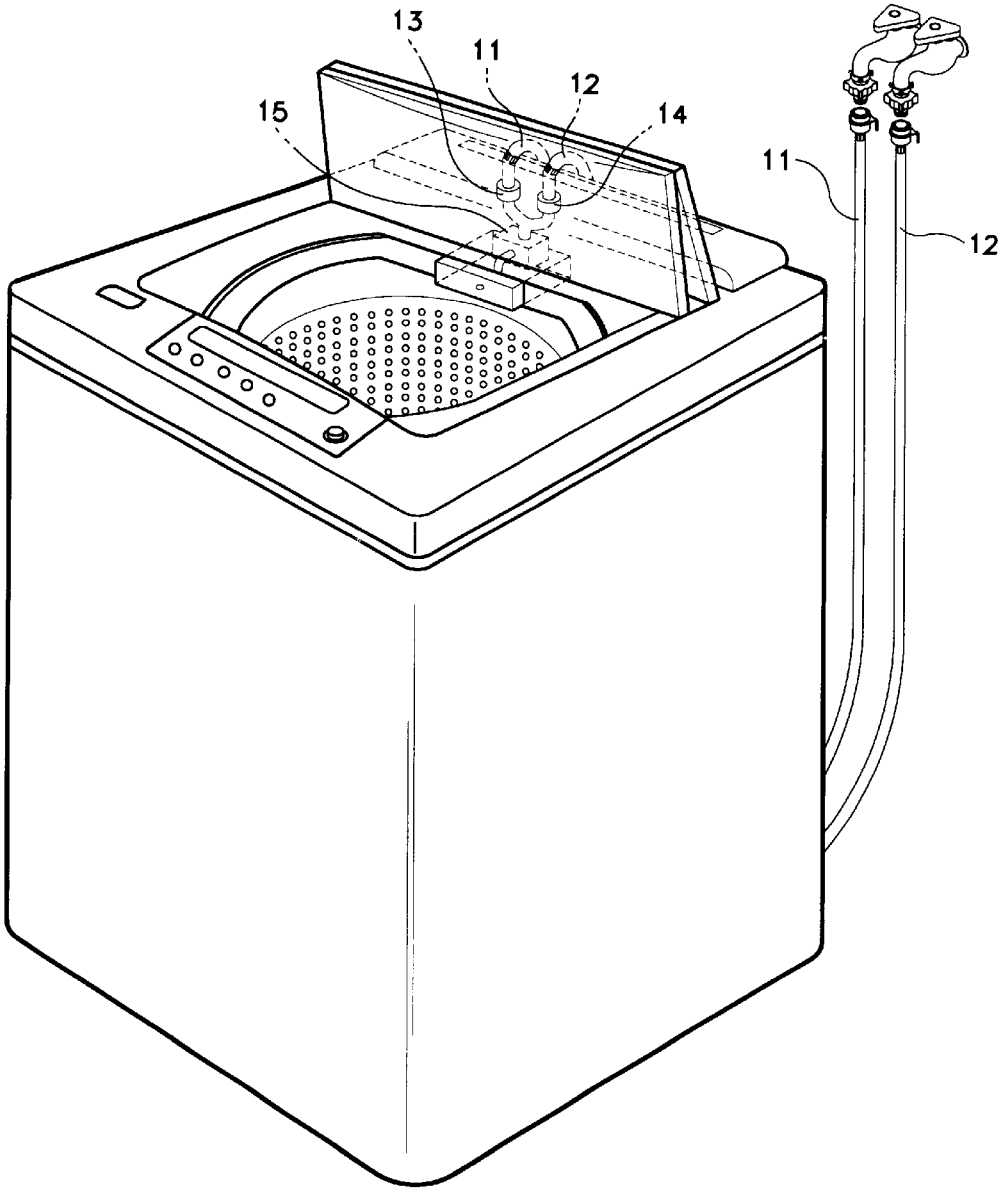
FIG. 1 (PRIOR ART)
FIG. 1 is a perspective view of a conventional washing machine.
Figure 2:
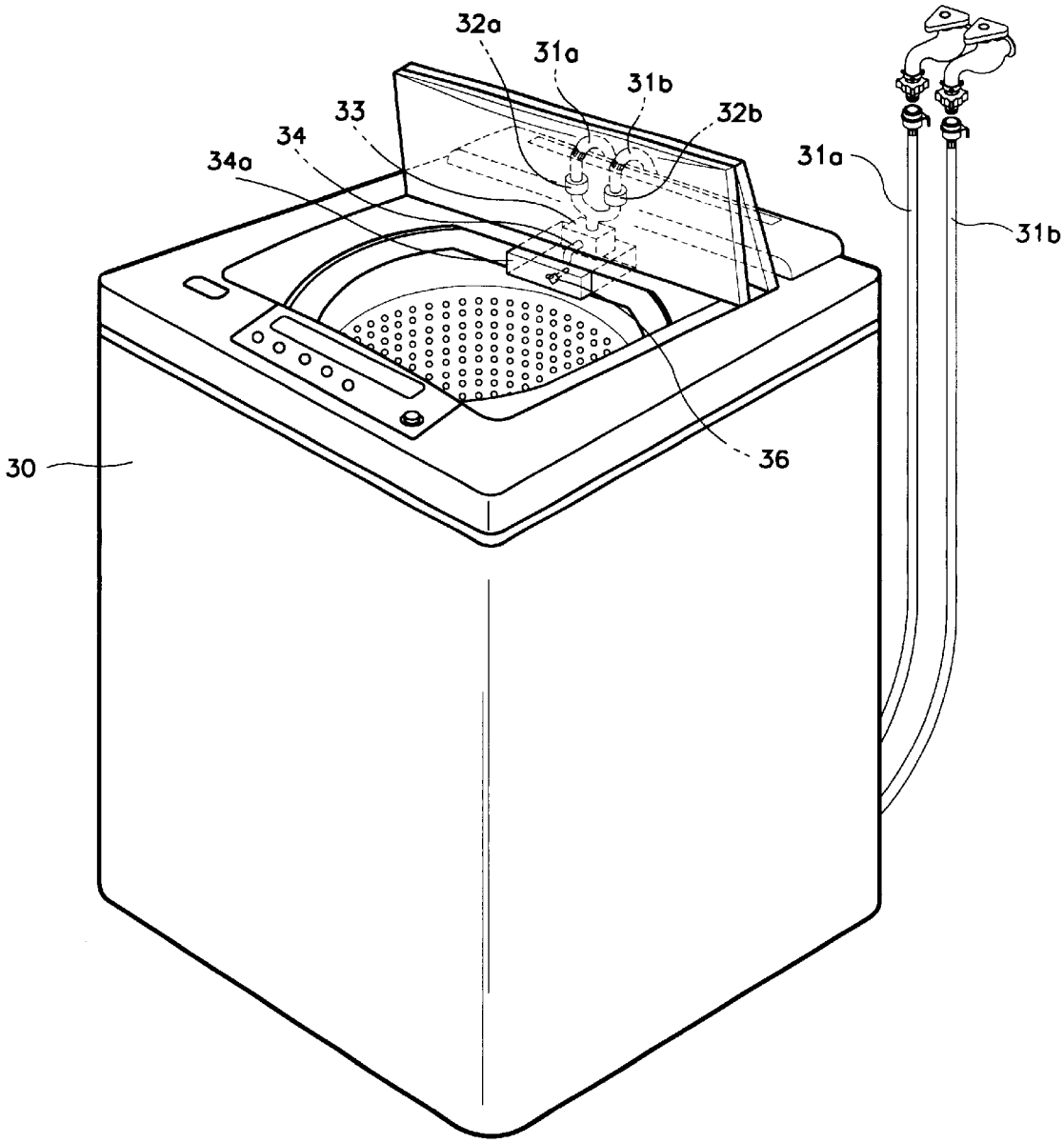
FIG. 2 is a perspective view of a washing machine equipped with a system for warning of an abnormal water supply according to a preferred embodiment of the present invention.
Figure 3:
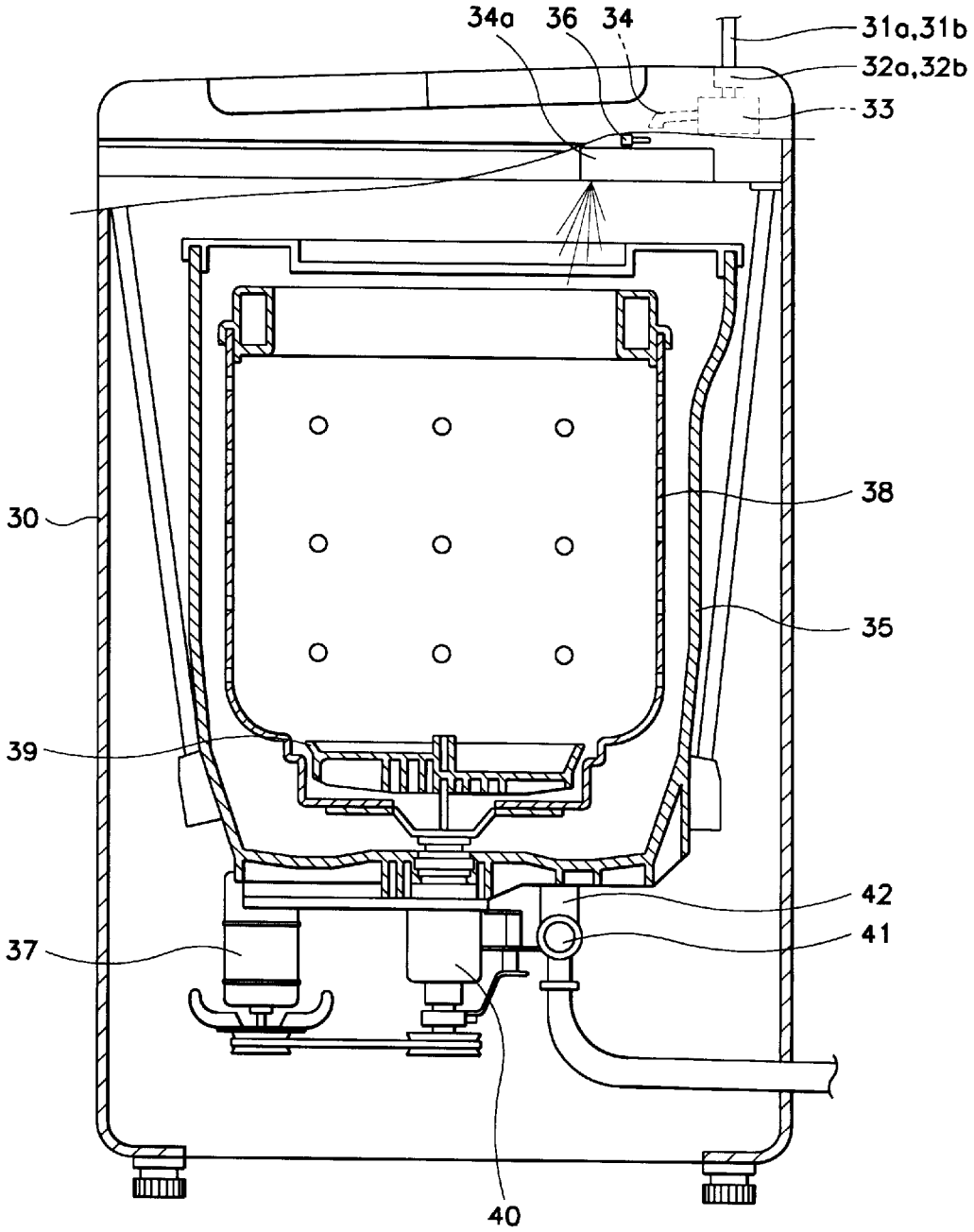
FIG. 3 is a right side sectional view of FIG. 2.

Referring first to FIGS. 2 and 3, there is shown a washing machine according to a preferred embodiment of the present invention.

This washing machine comprises a cool water supply hose 31*a* and a hot water supply hose 31*b*, which extend from a top of a main body 30 to be releasably connected to respective corresponding taps. Cool and hot water supply valves 32*a* and 32*b* are mounted on the cool and hot water supply hoses 31*a* and 31*b*, respectively.

In addition, one end of each of the cool and hot water supply hoses 31*a* and 31*b*, which are proximal to the main body 30, are converged into one line which is directed inside a water supply housing 33. Formed on a lower end of the water supply housing 33 is a water supply port 34 for guiding the water into a water reserving drum 35.

As shown in FIG. 3, mounted under the water supply port 34 is a detergent box 34*a* for supplying detergent into the water reserving drum 35 together with the water through a detergent feeding hole (not shown). Rotatably mounted within the water reserving drum 35 is a washing drum 38 on a bottom of which a pulsator 39 for forming water current is rotatably mounted. The water fed to the water reserving drum 35 is used to wash the laundry as the washing drum 38 and the pulsator 39 are operated, and is then drained outside through a water drain valve 41 connected to a lower end of the water reserving drum 35 and a water drain port 42.

Mounted in the vicinity of the water supply port 34 is a temperature sensor 36. Preferably, the temperature sensor 36 is mounted just under the water supply port 34 so as to detect the temperature of water being supplied through the water supply port 36 or to detect the air temperature around the water supply port 34 when water is not supplied. Preferably, a thermistor can be used as the temperature sensor 36.

Figure 4:
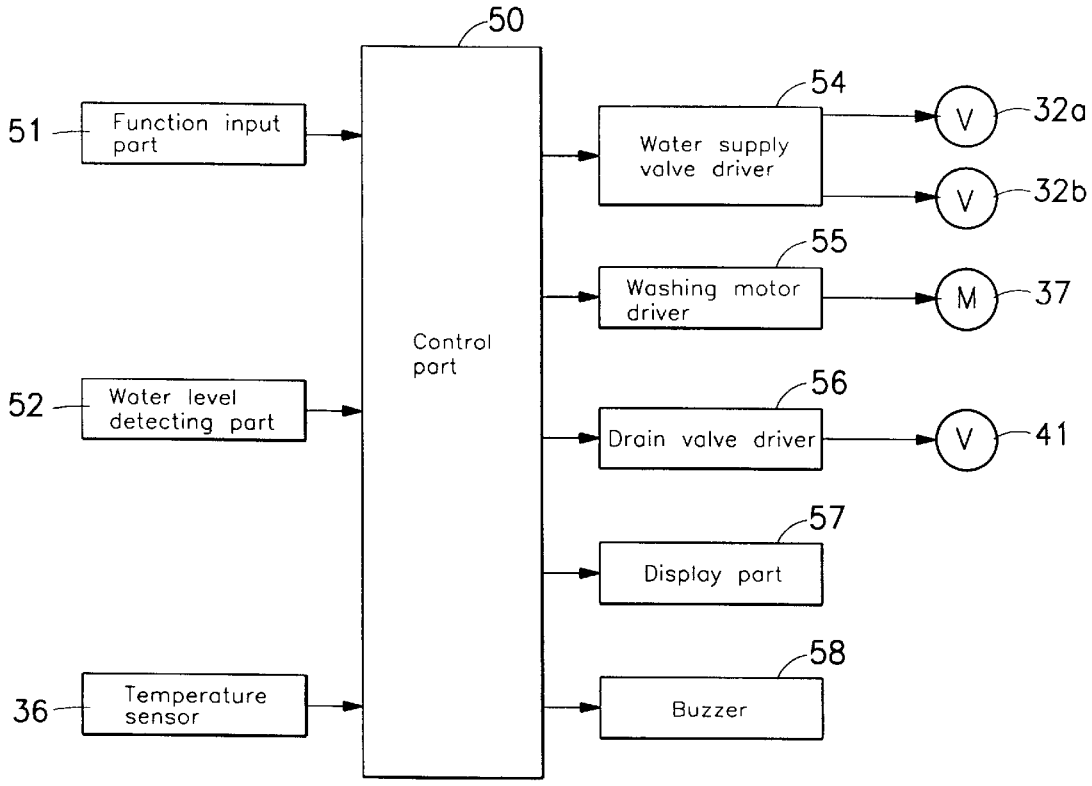
FIG. 4 is a block diagram illustrating a system for warning of an abnormal water supply according to a preferred embodiment of the present invention.

FIG. 4 shows a system for warning of an abnormal water supply according to a preferred embodiment of the present invention.

As shown in the drawing, the temperature sensor 36 is coupled to an input terminal of a control part 50. The temperature sensor 36 detects: (a) when water is not supplied, an ambient air temperature and outputs signals corresponding to the detected temperature to the control part 50, and (b) when water is supplied, the temperature of the water being supplied and outputs signals corresponding to the detected water temperature to the control part 50.

A function input part 51 for inputting functions of the washing machine such as water temperature, and a water level detecting part 52 for detecting a water level are further coupled to the control part 50. Coupled to an output terminal of the control part 50 are: a water supply control part 54 for on/off-controlling the water supply valves 32*a* and 32*b*; alarm display and bell/buzzer parts 57 and 58 for warning of an abnormal water supply by displaying a warning and sounding an alarm, respectively; a washing motor control part 55 for controlling a washing motor 37; and a water drain control part 56 for controlling the water drain valve 41.

Now, a method for warning of an abnormal water supply according to the present invention will be described hereinafter with reference to FIGS. 5A to 5C.

Figure 5A:
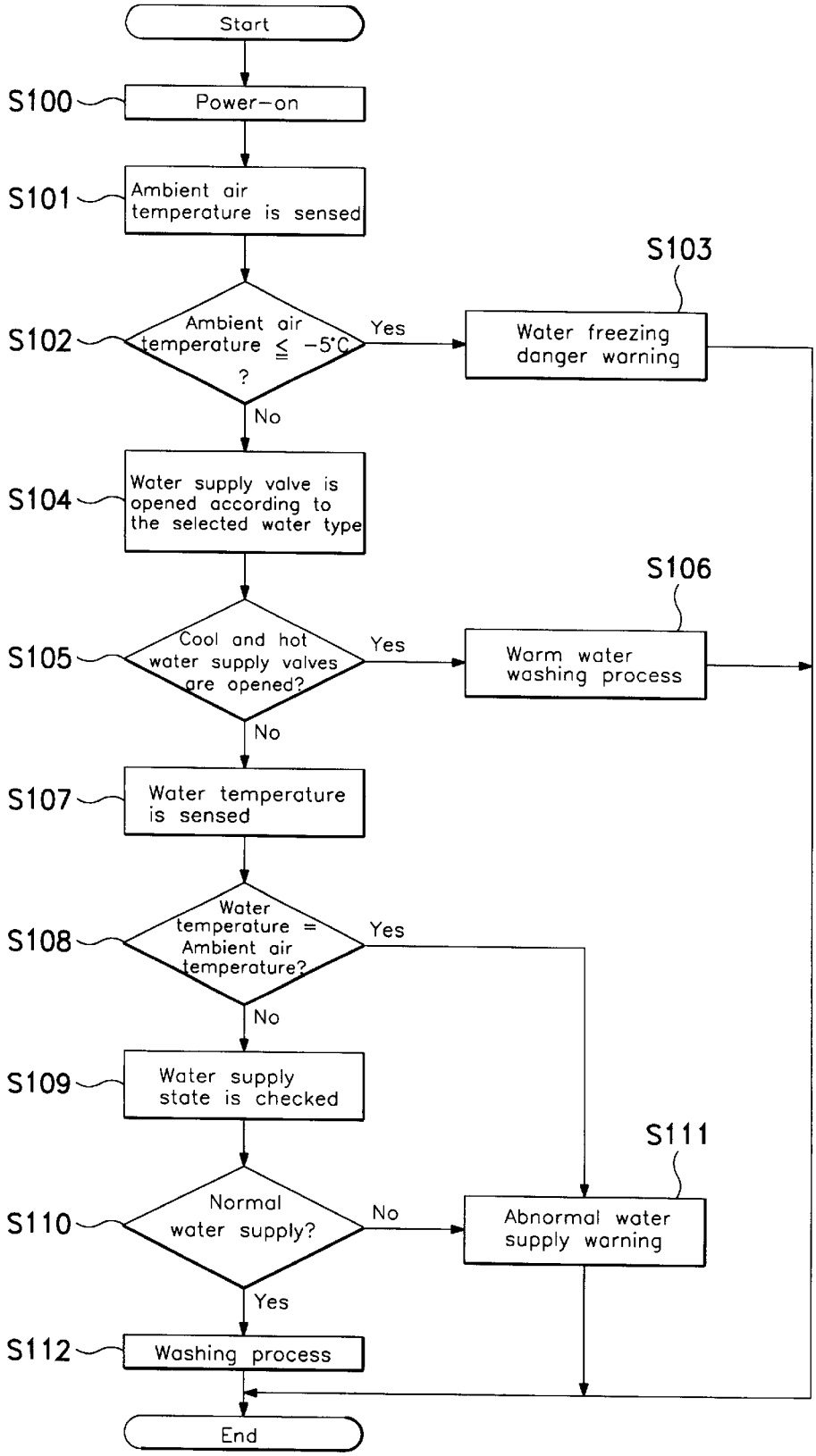
FIG. 5A is a flow chart illustrating a method for warning of an abnormal water supply in a washing machine according to a preferred embodiment of the present invention.

Referring first to FIG. 5A, when the washing machine is turned on by a user operating a power switch of the function input part 51 (step S100), the temperature sensor 36 mounted in the vicinity of the water supply port 34 detects a temperature of ambient air and transmits signals corresponding to the detected temperature to the control part 50 (step S101). The control part 50 determines, on the basis of the signals transmitted from the temperature sensor 36, if the detected temperature is lower than a predetermined level below which water can be frozen (step S102). Preferably, the predetermined temperature is set at a range of 05° C.

If the detected temperature is lower than the predetermined temperature in step S102, warning letters such as for example "freezing warning" are displayed in the display part 57 and, at the same time, a warning sound is output through the alarming bell 58.

If the detected temperature is higher than the predetermined minimum temperature, the control part 50 controls the water supply valve control part 54, in accordance with the water temperature (i.e., cool water, warm water, and hot water) selected by the user, to open one or both of the cool and hot water supply valves 32*a* and 32*b* (step S104).

That is, if the user selects cool water by manipulating the key input part 51 in step S104, the control part 50 sets open/close parameters Vc and Vh of the respective cool and hot water supply valves 32*a* and 32*b* at "1" and "0," respectively, to turn on only the cool water supply valve 32*a*.

In addition, if the user selects hot water by manipulating the function input part in step S104, the control part 50 sets open/close parameters Vc and Vh of the respective cool and hot water supply valves 32*a* and 32*b* at "0" and "1," respectively, to turn on only the hot water supply valve 32*b*.

If the user selects warm water by manipulating the key input part 51 in step S104, the control part 50 sets both of open/close parameters Vc and Vh of the respective cool and hot water supply valves 32*a* and 32*b* at "1" to turn on both of the cool and hot water supply valves 32*a* and 32*b*.

As described above, in step S104, the cool and hot water supply valves 32*a* and 32*b* are selectively opened according to the water temperature selected by the user, thereby feeding the appropriate water into the water reserving drum through the water supply housing 33, the water supply port 34, and the detergent box 34*a*.

Next, in step S105, it is determined if both of the cool and hot water supply valves 32*a* and 32*b* are turned on or not. If both of the cool and hot water supply valves 32*a* and 32*b* are turned on (i.e., Vc="1" & Vh="1"), a warm water washing process is performed in Step 106.

If at least one of the cool and hot water supply valves 32*a* and 32*b* is turned on, the temperature sensor 36 detects the temperature of the water being supplied (step S107).

A method for detecting the temperature of water will be described more in detail with reference to FIGS. 5B and 5C.

Figure 5B:
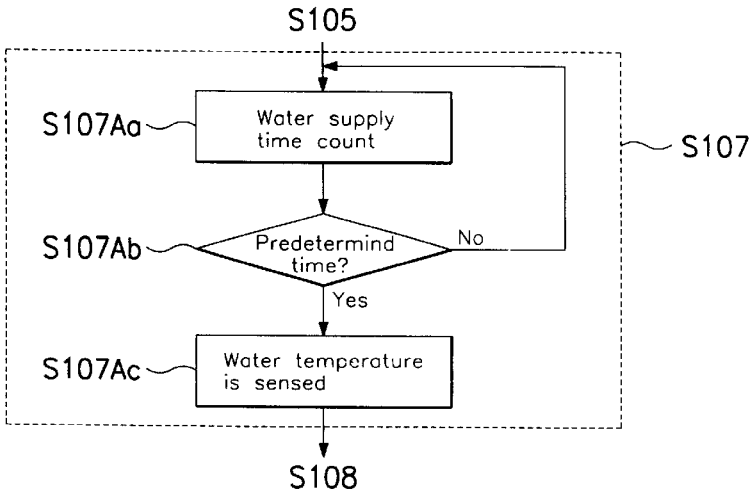
FIG. 5B is a flow chart illustrating detailed steps of a temperature detecting step described in FIG. 5A according to a first embodiment of the present invention.

FIG. 5B shows a method for detecting the temperature of water according to a first embodiment of the present invention.

In this embodiment, the temperature of water is detected after the lapse of a predetermined time from the start of water supply. This is to prevent a water temperature detecting error caused by a difference in temperature between water supplied initially and water supplied subsequently.

Describing this process more in detail, when one of the cool and hot water supply valves 32*a* and 32*b* is turned on by the control part 50, thereby starting the water supply through the water supply port 34, a water supply time Tw is counted by a counter (not shown) (step S107Aa).

Next, the control part 50 determines if the water supply time reaches a predetermined time Ts or not (step S107Ab). Here, the predetermined time Ts is set through a plurality of tests while considering a temperature deviation caused when the predetermined time is too short and a deterioration of response caused when the predetermined time is too long. Preferably, the predetermined time is set at 10 seconds.

In step S105Ab, if the water supply time Tw does not reach the predetermined time Ta, the processing step is returned to step S107Aa to further supply water.

In step S105Ab, if the water supply time Tw reaches the predetermined time Ta, the temperature sensor 36 detects the temperature of water being supplied through the water supply port 34 (step S107Ac).

Figure 5C:
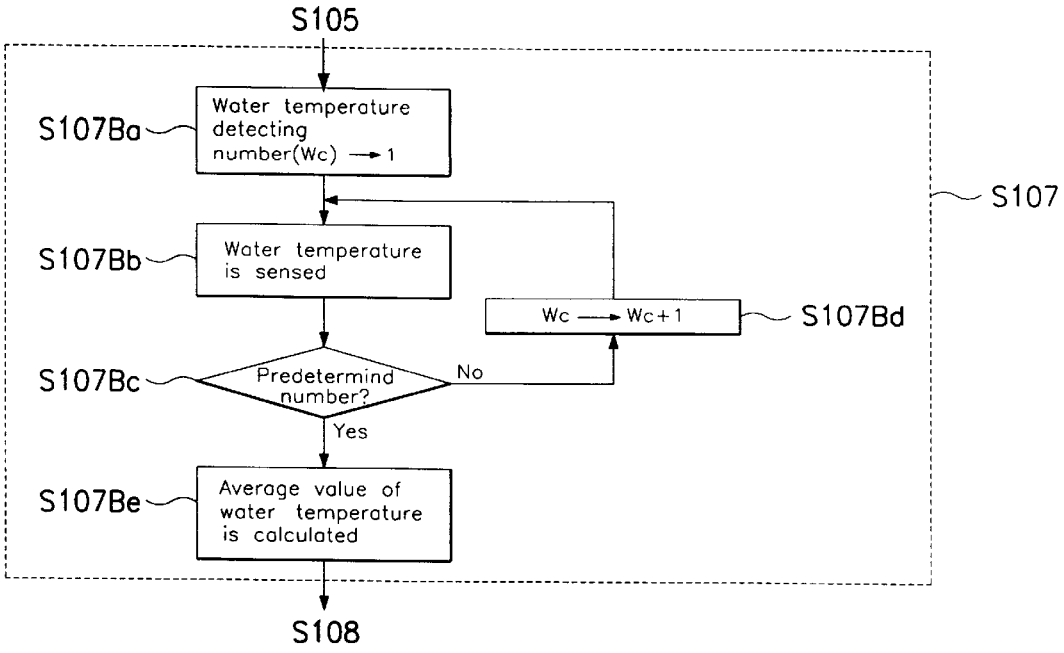
FIG. 5C is a flow chart illustrating detailed steps of a temperature detecting step described in FIG. 5A according to a second embodiment of the present invention.

FIG. 5C shows a method for detecting temperature of water according to a second embodiment of the present invention.

In this embodiment, the temperature of water is detected many times with a predetermined time interval, then a mean temperature is calculated.

The control part 50 sets an initial parameter of a parameter Wc of the water temperature detecting number as "1" to count the water temperature detecting number when supplying water by turning on the cool and hot water supply valves 32*a* and 32*b* (step S107Ba). Next, the control part 50 determines the temperature of water being supplied through the water supply port 34 according to temperature signals transmitted from the temperature sensor 36 (step S107Bb). Then, it is determined if the parameter Wc of the water temperature detecting number reaches a predetermined number N (step S107Bc). Here, the predetermined number N is determined through a number of tests while considering time and accuracy. Preferably, the water temperature detecting number is set at 10 times.

In step S107Bc, if the parameter of the water temperature detecting number Wc does not reach the predetermined number N, the parameter Wc is added by "1" (step S107Bd), then the process is returned to step S107Bb.

If the parameter Wc reaches the predetermined number N, the control part 50 calculates a mean value of the detected temperatures and determines the mean value as a temperature of water being supplied.

When a temperature of the water being supplied is determined through one of the first and second embodiments, it is determined if the water temperature detected in step S107 is identical to an ambient air temperature detected in step S101 for a predetermined time or not (step S108).

If the ambient air temperature and the water temperature are identical to each other for a predetermined time, the control part 50 determines that water is not supplied and gives an alarm of an abnormal water supply to the user in step S111.

If the ambient air temperature and the water temperature are not identical to each other for a predetermined time in step S109, a water supply state or type is checked according to a detected water temperature. This will be described more in detail hereinbelow.

The control part 50 sets a parameter Ws of a water supply state as "1" or "2" according to a water temperature detected by the temperature sensor 36. At this point, although it is not limited to set a temperature range of cool/hot water, in this embodiment, if a temperature of the water is above 25° C., the water state is determined as hot water, and if below 25° C., the water state is determined as cool water.

That is, in step S109, if the water temperature detected by the temperature sensor 36 is within a hot water range (i.e., above 25° C.), the parameter Ws of the water supply state is set as "2," and if within a cool water range (i.e., blow 25° C.), set as "1."

Next, the control part 50 determines if the water is normally supplied or not according to setting states of parameters Ws, Vc and Vh of the respective water supply state, cool water valve open/close state, and hot water supply open/close state.

That is, when the parameter Ws of the water supply state is set as "1," if the parameter Vc of the cool water open/close state is set as "1" and the parameter Vh of the hot water valve open/close state is set as "0," it is determined that the water is normally supplied and washing process is performed in step S112.

When the parameter Ws of the water supply state is set as "1," if the parameter Vc of the cool water open/close state is set as "1" and the parameter Vh of the hot water valve open/close state is not set as "0," it is determined that the water is abnormally supplied and the control part 50 gives an alarm to the user in step S11.

In addition, when the parameter Ws of the water supply state is set as "2," if the parameter Vh of the hot water open/close state is set as "1" and the parameter Vc of the cool water valve open/close state is set as "0", it is determined that the water is normally supplied and washing process is performed in step S112.

When the parameter Ws of the water supply state is set as "1," if the parameter Vh of the hot water open/close state is set as "1" and the parameter Vc of the cool water valve open/close state is not set as "0," it is determined that the water is abnormally supplied and the control part 50 gives an alarm to the user in step S111.

In step S111, to give an alarm to the user, warning letters such as "abnormal water supply" can be displayed on the display part 57 and, at the same time, a warning sound can be output through the alarming bell 58.

As described above, the abnormal water supply state is alarmed through the display part 57 and the warning bell 58, so that the user can fix the water supply state by checking connection states of the hoses to the taps.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method for warning of an abnormal water supply in a washing machine having cool and hot water supply valves for respectively supplying hot and cool water, said method comprising the steps of:

detecting a temperature of ambient air of a water supply port of the washing machine before at least one of the cool and hot water supply valves of the washing machine is opened;

detecting a temperature of water being supplied to the washing machine when at least one of the cool and hot water supply valves is opened;

determining whether each of the respective cool and hot water supply valves is opened or closed;

comparing the detected temperature of ambient air with the detected temperature of water;

giving an alarm of an abnormal water supply when the detected temperature of ambient air and the detected temperature of water are identical to each other for a predetermined time;

identifying a temperature type of water being supplied according to the detected temperature of the water;

determining whether the water is normally or abnormally supplied by comparing the determined opened cool and/or hot water supply valves with the temperature type of water identified; and giving an alarm of an abnormal water supply when the water is determined in said determining step to be abnormally supplied.

2. A method for warning as claimed in claim 1 wherein the step of detecting a temperature of water further comprises the steps of:

counting a water supply time;

determining whether the water supply time reaches a predetermined time or not; and detecting a temperature of the water when the water supply time reaches the predetermined time.

3. A method for warning as claimed in claim 1 wherein the step of detecting a temperature of water further comprises the steps of:

detecting a temperature of water many times at a predetermined time interval;

determining whether the number of temperature detecting times reaches to a predetermined number or not; and calculating a mean temperature when the number of temperature detecting times reaches to the predetermined number.

4. A method for warning as claimed in claim 1 wherein if it is determined that cool water is supplied and it is determined that both the cool and hot water supply valves are opened, said determining whether the water is normally or abnormally supplied step determines that the water is abnormally supplied.

5. A method for warning as claimed in claim 1 wherein if it is determined that hot water is supplied and it is determined that both the cool and hot water supply valves are closed, said determining whether the water is normally or abnormally supplied step determines that the water is abnormally supplied.

6. A method for warning as claimed in claim 1 wherein the step of giving an alarm of an abnormal water supply is provided by displaying warning letters or making a warning sound.

7. A method for warning of an abnormal water supply in a washing machine, comprising the steps of:

detecting a temperature of ambient air of a water supply port of the washing machine before at least one of the cool and hot water supply valves of the washing machine is opened;

determining a temperature of water being supplied through the water supply port after only one of the cool and hot water supply valves is opened;

comparing the detected temperature of ambient air with the determined temperature of water; and giving an alarm of an abnormal water supply when the detected temperature of ambient air and the determined temperature of water are identical to each other for a predetermined time.

8. A system for giving an alarm of an abnormal water supply in a washing machine having a water drum, cool and hot water supply hoses for directing water into the water drum, cool and hot water supply valves mounted on the cool and hot water supply hoses, respectively, and a water supply port through which the water passing through the cool and hot water supply valves is supplied to the water drum, the system comprising:

a temperature detecting sensor disposed in the vicinity of the water supply port which detects a temperature of an ambient air prior to opening of any water supply valve and of water being supplied through the water supply port after opening of any water supply valve;

means for determining an abnormal water supply in accordance with the ambient air temperature detected and the water temperature detected by the temperature detecting sensor; and means for giving an alarm to a user when the means for determining determines the abnormal water supply.

9. A system for warning as claimed in claim 8 wherein the means for determining further:

determines whether cool and hot water supply valves are opened or closed, detects a temperature of water being supplied to the washing machine when at least one of the cool and hot water supply valves is opened, identifies a temperature type of water being supplied according to the detected temperature of the water, determines whether the water is normally or abnormally supplied by comparing the determined opened cool and/or hot water supply valves with the temperature type of water identified, and gives an alarm of an abnormal water supply when the water is abnormally supplied.

10. A system for warning as claimed in claim 8 wherein the means for determining further:

detects a temperature of ambient air of a water supply port of the washing machine before at least one of the cool and hot water supply valves is opened, determines a temperature of water being supplied after only one of the cool and hot water supply valves is opened, compares the detected temperature of ambient air with the determined temperature of water, and gives an alarm of an abnormal water supply when the detected temperature of ambient air and the determined temperature of water are identical to each other for a predetermined time.

* * * * *